US005310275A

United States Patent [19]

Lovitt

[11] Patent Number: 5,310,275

[45] Date of Patent: May 10, 1994

[54] UNIVERSAL COUPLER

[76] Inventor: Estel L. Lovitt, 2266 Brendon Way, Sylvania, Ohio 43560

[21] Appl. No.: 443,746

[22] Filed: Nov. 30, 1989

[51] Int. Cl.[5] ..... E02F 9/00

[52] U.S. Cl. ..... 403/322; 403/24; 37/468

[58] Field of Search ..... 403/24, 322; 37/117.5, 37/118 R, 118 A, DIG. 3, DIG. 12, 468, 463, 903

[56] References Cited

U.S. PATENT DOCUMENTS

| | | | |
|---|---|---|---|
| 3,417,888 | 12/1968 | Naab | 414/407 |
| 3,760,883 | 9/1973 | Birk | 37/231 X |
| 4,203,238 | 5/1980 | Bangert et al. | 37/118 R |
| 4,480,955 | 11/1984 | Andrews et al. | 37/117.5 X |
| 4,586,867 | 5/1986 | Stafford | 403/322 X |
| 4,708,579 | 11/1987 | Baird et al. | 414/723 |
| 4,810,162 | 3/1989 | Foster | 37/118 A |
| 4,858,345 | 8/1989 | Abe et al. | 37/118 R |
| 4,963,071 | 10/1990 | Larwin et al. | 37/118 R X |

*Primary Examiner*—Randolph A. Reese
*Assistant Examiner*—Anthony Knight
*Attorney, Agent, or Firm*—George R. Royer

[57] ABSTRACT

The subject apparatus is an improved coupling apparatus utilized for various work vehicles, on which is integrally disposed a front end functional member capable of a plurality of movements and work functions controlled by the operator of the work vehicle, such coupling apparatus comprising a connecting member which is comprised of an upright support member wherein such support member has parallel vertical slots to receive movable connecting arms from the work vehicle, along with a V-shaped guide on the upper portion to receive a portion of the device to be coupled to the coupler.

5 Claims, 2 Drawing Sheets

UNIVERSAL COUPLER

DESCRIPTION OF PRIOR ART AND BACKGROUND OF INVENTION

This invention pertains to the area of coupling mechanisms used as an intermediate member to facilitate the coupling of a work member to facilitate the coupling of a work member to a vehicle, with such work member comprising front-end loaders, grading and other similar apparatus. In particular, the subject invention is an intermediate coupling apparatus adapted for coupling on the forward portion of a work vehicle, functional device such as front end loader, grader or other work attachment. Such functional attachments are usually appended in temporary fashion to the front of a vehicle as a working device having a specified function. Such vehicles are generally adapted to have a variety of such work attachments appended thereto and, in general, such working implements are attached to the front of the vehicle. With the ability to temporarily attach such work implements, the work vehicle is provided with a broad functional diversity.

There are several obvious advantages to utilize one vehicle as a base functional member to which a variety of work members can be appended as the need arises. With such a universal coupling device, as envisioned by the invention herein, there is thus no need to retain several vehicles each with unitary specialized appendages, and one vehicle can suffice to which all the work appendages can be attached. The subject invention is also conceived as an apparatus to efficiently and safely effect the coupling process.

In view of the foregoing, the following objects of the subject invention are directed accordingly.

OBJECTS

The objects of the subject invention are as follows:

It is an object of the subject invention to provide an improved coupling device for work vehicles;

Yet another object of the subject invention is to provide an efficient and improved coupling device for work vehicles;

A further object of the subject invention is to provide an improved concept of coupling a temporary functional member to a vehicle;

Still another object of the subject invention is to provide a device that is a universal coupler for work machines;

Another object of the subject invention is to provide an improved and versatile coupling device as used on various work vehicles;

Other and further objects of the subject invention will become apparent from a reading of the following descriptions taken in conjunction with the claims and drawings.

DRAWINGS

DESCRIPTION OF GENERAL EMBODIMENT

The subject apparatus is an improved coupling apparatus utilized for various work vehicles, on which is integrally disposed on a front end functional member capable of a plurality of movements and work functions controlled by the operator of the work vehicle, such coupling apparatus comprising a connecting member which is comprised of an upright support member wherein such support member has parallel vertical slots to receive movable connecting arms from the work vehicle, along with a V-shaped guide on the upper portion to receive a portion of the device to be coupled to the coupler.

DESCRIPTION OF PREFERRED EMBODIMENT

In describing the preferred embodiment of the subject invention, it is to be noted that the following description shall be of only one embodiment of several that are within the scope of the invention herein, and this description of a particular embodiment shall not be considered as limiting the scope of the invention herein. Moreover, in describing the subject invention, the following nomenclature shall be used. The word "upper" shall refer to those areas above the ground level, while the word "lower" will refer to those areas adjacent or near the ground level as appertaining to a vertically disposed device, as described. Moreover, in reference to the vehicle to which the subject apparatus is affixed, the word "frontal" will be used in reference to the first portion of such vehicle, while the word "posterior" will be used in opposite reference thereto.

Figures 1, 2:
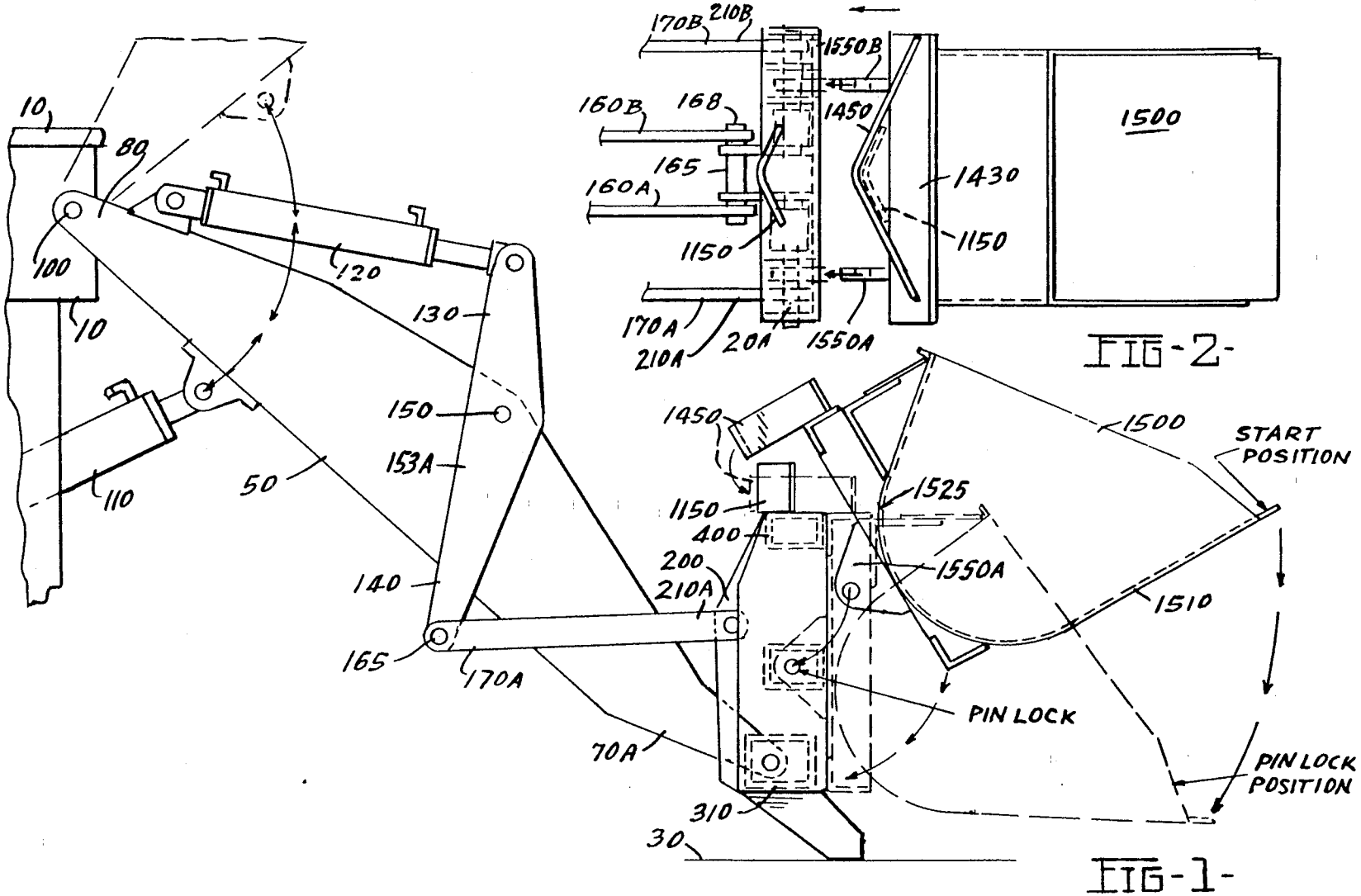
FIG. 1 is a side elevational view of the subject invention, showing the relative position of the coupler to the overall vehicle structure to which it is affixed.
FIG. 2 is a top elevational view of the subject invention, showing partially the coupling arrangement shown in FIG. 1.

Referring now to the drawings and particularly to FIGS. 1 and 2, the extreme front end 10 of a land-based motorized work vehicle is shown. It is understood that the work vehicle is a conventional self-propelled vehicle, which vehicle is adapted to be driven over the ground 30 on wheels, not shown, or on railroad tracks, not shown, on appropriate rail wheels. Such land-based vehicle may be adapted to be propelled over either ground or on rail tracks, but the subject invention is equally applicable to any type of land-based vehicle. As shown, the vehicle is equipped with a pivotable working arm member 50, which is a longitudinal member with a front end 70 and a posterior end 80. As can be seen, posterior end 80 is pivotably mounted on a horizontal axial shaft 100, as shown in FIG. 1.

As can be seen such working arm 50 may be comprised of parallel beam components 160A and 160B as a longitudinally extending member. As can be seen from the drawings, the working arm 50 is pivotable upward and downward about shaft 100 from the approximate downward position to the upward position shown in phantom in FIG. 1. As seen in FIG. 1, the working arm is actuated by hydraulically activated piston member 110.

Furthermore, as can be seen in FIG. 1, working arm 50 comprised of parallel beam components 160A and 160B is basically a straight member with the posterior end 80 pivotably mounted about shaft 100. The upper portion of such work arm 50 is equipped with hydraulically actuated piston 120 that is equipped to reciprocate intermediately disposed parallel pivotable vertical rods 153A, with the other parallel rod not being shown. These latter rods are rotatably mounted for a limited pivotable movement about shaft 150. Pivotably mounted on the lower end 140 of these vertical rod members, through shaft 165, are parallel front link members 170A and 170B. As can be seen the frontal link arms 170A and 170B are reciprocally movable back and forth in a generally reciprocally-oriented linear movement that would be normally parallel to the ground 30. These foregoing elements are generally conventional on most work vehicles adapted to hold and utilize a front end loader.

The subject invention is a coupling member 200 that is adapted to be affixed with the frontal end 70A of the working arm 50 and the frontal ends 210 and 210B of the frontal link members 170A and 170B, as seen in the drawings. This coupling member 200 functions as a universal coupler to the front of which may be affixed various work elements, such as a grader, loader, backhoe, or other similar device. The purpose of such a universal coupling element 200 is to permit the working arm 50 of the land-based vehicle to be used with such different work elements from time to time, as the work function so dictates and coupled and uncoupled with relative ease. Such a coupling member 200 is adapted to receive and hold all such work elements.

The coupling member 200 is generally a rectangular member structured in a vertically disposed plane in a generally upright manner. As stated above, the universal coupling member 200 is adapted to be affixed to the frontal portions 210A and 210B of the frontal link arms 170A and 170B as well as the frontal end 70 of the pivotable working arm 50, as seen in FIGS. 1 and 2, and as more fully described below.

Figure 3:
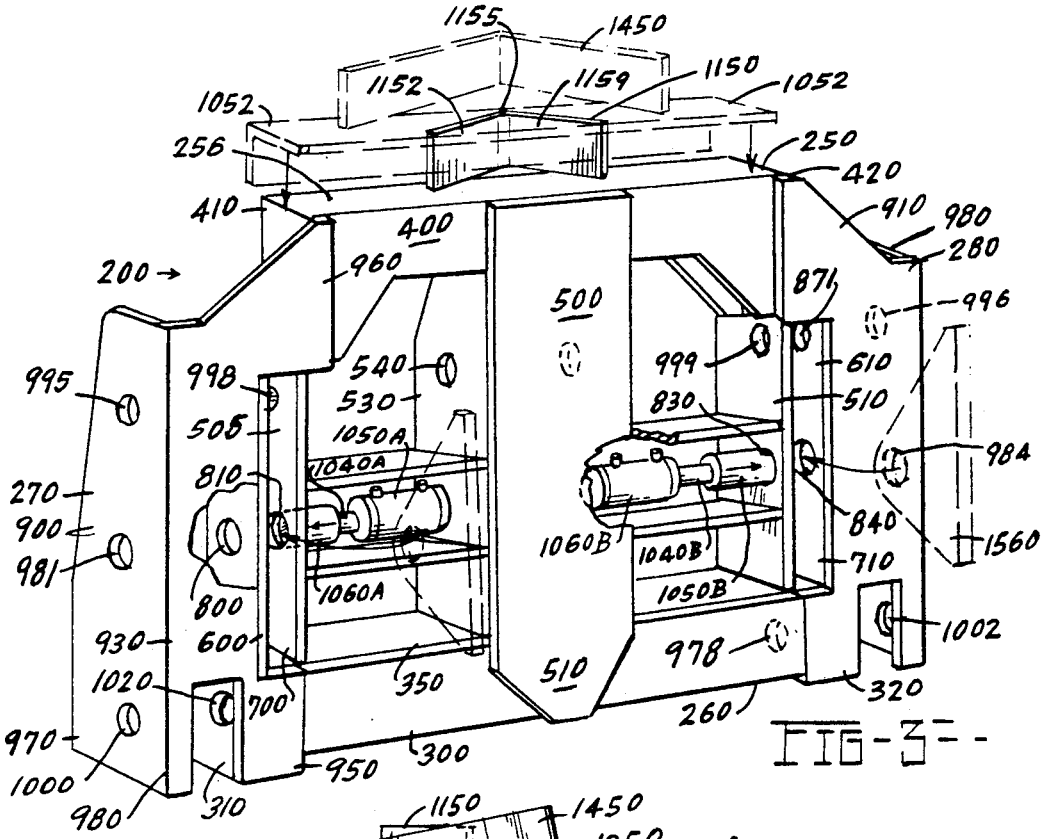
FIG. 3 is a perspective view of the subject apparatus.

The coupling member 200, as viewed from the frontal perspective view of FIG. 3, is shown as a generally rectangular member having an upper portion 250 and a lower portion 260, with left side 270 and a right side 280, such right-left orientation being derived from the frontal orientation shown in FIG. 3. As seen in FIG. 3, the bottom portion 260 of the coupling member 200 is formed by a horizontal cross brace 300. In the embodiment shown in FIG. 3, the cross brace 300 is a parallelopiped-shaped member having a hollow interior. Moreover, as seen in FIG. 3, the cross brace 300 does not extend over the entire length of the bottom portion 260 of the coupling member 200, but rather is indented an equal distance from the left side 270 as well as the right side 280. The respective left end 310 and right end 320 of the lower cross brace member 300 are formed with a circular opening 1020 on the left end 310 of the cross brace member and a similar opening 978, shown in phantom in FIG. 3, on the right end 320 of such cross brace member 300.

Extending lengthwise over the upper portion 250 of the coupling member 200 is upper cross brace member 400. As seen, the upper cross brace member 400 does not extend over the entire upper length of the coupling member 200, but as in the case of the lower cross brace member, extends short of the overall left end and the right end of the upper part of the upper portion of the coupling member 200, with upper cross brace member 400, left end 410 and right end 420 defining the upper left and right extremes of the upper portion 250 of the coupling member 200.

Joining, in a vertically upright manner, the lower cross brace member 300 with the upper cross brace member 400, is vertically disposed medial support member 500. Medial support member 500 comprises a front vertical plate 510 that flanks the frontal surfaces of both the lower cross brace member 300 and the upper cross brace member 400, as seen in FIG. 3. The posterior portion of the medial support member 500 is comprised of a vertical brace 530 that joins the rear face of plate 500 in T-shaped fashion, as shown in FIG. 3. The medial support member 500 is disposed in the middle part of the coupling member 200 and functions as the middle vertical support member for such coupling device 200.

As seen in FIG. 3, the upper part of vertical brace 530 has a circular opening 540 extending therethrough, which circular opening 540 is adapted to receive a circular shaft member.

Attention is again directed to FIG. 3, and shown extending vertically downwardly from the ends 410 and 420 of the upper cross brace member 400 are first left vertical side plates 505 and 510. More specifically, the upper part of first vertical side plate 505 is joined to a portion of the left end 410 and extends vertically downwardly to be integrally joined to the upper surface 350 of the lower cross brace member, at a portion near the left end 310 of the lower cross brace member 300. In similar fashion, the first right vertical plate member 510 joins a portion of the right end 420 of the upper cross brace member 400 with a portion of the upper surface of lower cross brace member 300 adjacent the right end 320 of such lower cross brace member 300.

As shown in FIG. 3, just immediately to the left of first vertical plate member 505 is second left vertical plate member 600, that is spaced a distance from the first left vertical plate member 505 and extends downwardly in parallel fashion to the first left vertical plate member 505. As seen in the drawings, second left vertical plate member 600 is affixed in perpendicular fashion at the left end 310 of bottom brace member 300.

In similar fashion, second right vertical plate 610 flanks the first right vertical plate 510 in a spaced-apart parallel relationship, as shown in FIG. 3. Thus, as can be seen, there is a spatial separation 700 between first left vertical plate 505 and second left vertical plate 600, which spatial separation is alternately referred to as left vertical slot 700, while on the right side of the coupling device 200, there is a comparable vertical slot 710 that parallels and mirrors the left vertical slot 700, as seen, between plates 610 and 510.

As shown, both the first left vertical plate 505 and the second left vertical plate 600 have circular openings 800 and 810 extending therethrough, which latter two openings are coaxially aligned. In similar fashion, first right vertical plate 510 and second right vertical plate 610 have aligned circular openings 830 and 840, respectively.

Figure 4:
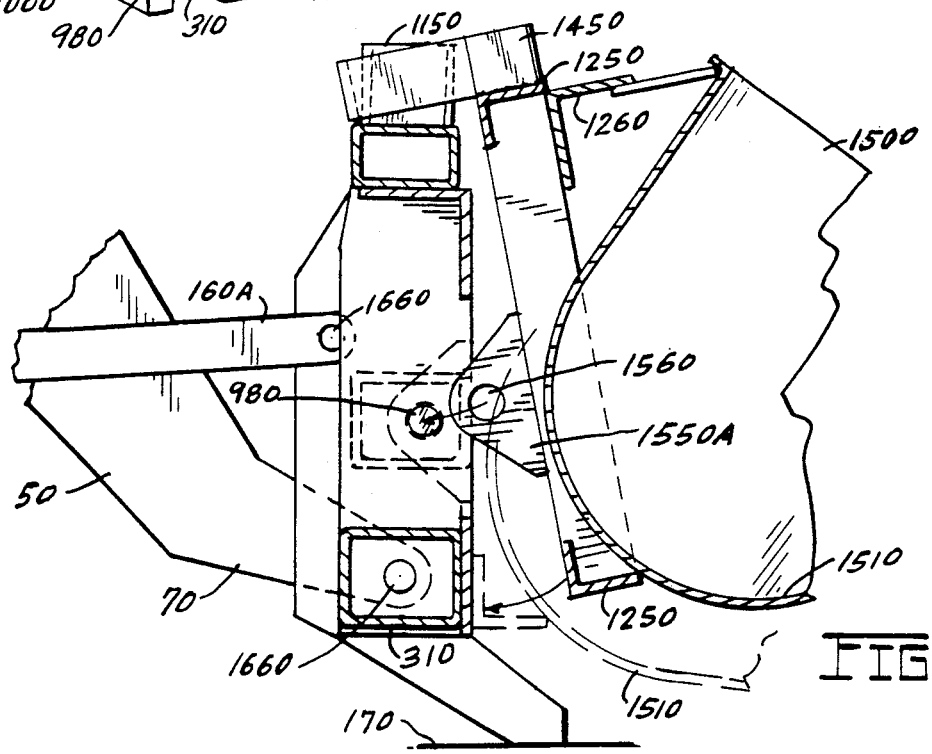
FIG. 4 is a side elevational view of the subject apparatus showing as it is about to be affixed to a front-end working vehicle.

As shown in the drawings, particularly FIGS. 3 and 4, each end of the coupler device 200 has an L-shaped extension 900 and 910, as seen from a top elevational view, integrally affixed on each end thereof. More particularly, integrally disposed on the left end 270 of the coupling device 200 is left extension member 900. Left extension member 900 comprises a front plate 930, the front face of which is generally aligned with the front face of the medial vertical brace support member 500, and which front plate is integrally affixed on its lower inner edge 950 to the left end of the lower cross brace member 300. The upper inner edge 960 of the frontal plate 930 is integrally affixed to the left end 410 of the upper cross brace member 400. As shown in FIG. 3, affixed integrally to the front plate 930 of left extension member 900 is left outer vertical side plate 970, and as seen, such left outer vertical side plate 970 is affixed to the extreme left edge 980 of the front plate 930, and is disposed perpendicular to the plane of the front plate 930, thereby forming an L-shape as seen from a top elevational view. In similar manner, right extension member 910 is affixed to the right ends of the lower cross brace member 300 and the upper cross brace member, having the same structure as left extension member 900, but in mirror image thereof.

As can be observed in FIG. 3, the left vertical side plate 970 has a circular opening 1000 in the lower extremity thereof which is aligned coaxially with a similar opening 1020 in the lower cross brace member 300. Additionally, right vertical plate 980 has circular openings 1002, 984 and 996, which are coaxially aligned respectively with circular openings 978 in the lower cross brace member 300, opening 840 in the second right vertical plate 610 and opening 871 in second right vertical plate 610, as shown.

Integrally disposed on the upper surface 256 of the upper cross brace member 400 is a V-shaped or wedged shape or connecting member 1150, which as shown is open towards the frontal portion of the coupling member 200. More specifically, the coupling member 200 has on its upper surface an auxiliary connecting member 1150, comprised of two rectangular arms 1152 and 1159 that meet in a V-shaped fashion at apex 1155, with the apex disposed towards the posterior portion of the top surface 256 of such upper cross brace member 400, as shown in the drawings. As such, the wedge appearance is directed towards the posterior part of the coupler and back towards the vehicle to which it is attached.

Additionally integrally affixed to posterior portion of the work implement 1500, specified a bucket, are cross brace members 1250 and 1260 affixed transversely to one another on the posterior face of such bucket. The wedge-shaped member 1450 is integrally affixed to the upper surface of cross brace 1250 to help position the wedge-shaped member 1450.

Referring again to FIG. 3, fixedly mounted plate 530, between plates and first left vertical plate 505 is a hydraulic cylinder 1050A, which is coaxially mounted to a reciprocally movable shaft 1040A having a reduced diameter compared to the diameter of the hydraulic cylinder 1050A. Affixed coaxially on the distal end of shaft 1040A is coaxially mounted shaft 1060A which has a relatively larger diameter than shaft 1040A. Shaft 1060A is adapted to reciprocally slide in and out of circular openings 810, 800, 981 respectively in first left vertical plate 505, second left vertical plate 600 and outer plate 970, upon the action of hydraulic cylinder 1050A. In the inwardly retracted position the shaft 1060A does not extend through any of the openings 810, 800, or 981 stated above. In similar manner, the hydraulic cylinder 1060B controls the reciprocating motion or placement of coaxial shafts 1040B and 1050B in and out of openings 830, 840 and 984.

In the embodiment shown in FIG. 4, a bucket 1500 is adapted to be fitted against coupler member 200, and such bucket is equipped with a mating wedge member 1450 adapted to be joined around the posterior side of wedge member 1150 to help lock the bucket against the coupler. Further, the bucket 1500 is provided with ears 1550A and 1550B on the posterior portion 1525 which fit into slots 700 and 710 respectively, and once these latter ears are aligned in the slots the cylinders 1050A and 1050B move shafts 1060A and 1060B through the openings 810, 800 and 981 and openings 830, 840 and 984 respectively to lock the ears 1550A in place. Additionally, the wedge-shaped member 1450 in the bucket 1500 is placed conformingly and securely around the back surface of the wedge-shaped member 1150 on the top of coupling member 200. This completes the locking of the bucket into the coupler member 200.

The coupler member 200 is affixed to the front end of working arm 50 by removable shaft 1660 inserted through openings 1000, 1020, 978 and 1002 in the lower part of the coupler member 200 with the forward parallel ends of working arm member inserted into the rear open portions of the left extension member 970 and right extension member 980. The forward part of arms 170A and 170B are affixed by a shaft inserted through openings 995, 998, 540, 999, 871, and 996 in the upper part of the coupler member 200.

In summary, the subject invention is a universal coupling device attached to the front end of a motor vehicle for attachment of various work implements to such work vehicle, such device coupling drive comprising a longitudinally extending base member having a longitudinal central axis, with a first main support member and second main support member, each such main support members having an upper portion and a lower portion, both said support members being vertically disposed members being parallel to one another in tandem fashion, both such main support members being integrally affixed on their respective lower portions to said base member, such first main support member and such second main support member each having a transverse opening in the upper portion wherein such transverse opening in the upper portions of such first and second main support members are coaxially aligned along a common axis, and wherein such first main support member and such second support member each having a second transverse opening disposed in that portion of the vertical main support members at a portion thereof above the base support member, such second transverse openings in such respective main support members being coaxially aligned along a common axis, and with a first secondary vertical support member and a second vertical secondary support member with the first such secondary vertical support member being integrally affixed in a position immediately outboard of such first vertical support member, and such second secondary support member being integrally affixed in a position immediately outboard of such second main vertical support member, such first and second vertical support members each having three sets openings therein, each set aligned along a common axis, with one such set being adapted to hold a connecting pin, with such first and secondary vertical support member each having outwardly turned upper portions, and with longitudinally extending bar means affixed between such first and second main vertical support member, such bar member being affixed in the first transverse openings of such first main support member and such second support member, such bar member being adapted to connect to a pair of hook-like ears on the rear portion of the attached work element.

Alternately stated, the subject invention is a universal coupling device attached to the front end of a motor vehicle for attachment of various work implements to such work vehicle, such coupling device comprising a longitudinally extending base member having a longitudinal central axis, with such first main support member and second main support member, each such main support members having an upper portion and a lower portion, both such support members being vertically disposed members being parallel to one another in tandem fashion, both such main support members being integrally affixed on their respective lower portions to such base member, such first main support member and such second main support member each having a transverse opening in the upper portion wherein such transverse opening in the upper portions of such first and second main support members are coaxially aligned along a common axis, and wherein such first main support member and such second support member each having a second transverse opening disposed in that portion of the vertical main support members at a portion thereof above the base support member, such second transverse openings in such respective main support members being coaxially aligned along a common axis, and with a first secondary vertical support member and a second vertical secondary support member with the first such secondary vertical support member being integrally affixed in a position immediately outboard of such first vertical support member, and such second secondary support member being integrally affixed in a position immediately outboard of such second main vertical support member, such first and second vertical support members each having three sets openings therein, each set aligned along a common axis, with one such set being adapted to hold a connecting pin, with such first and secondary vertical support member each having outwardly turned upper portions and with longitudinally extending bar means affixed between such first and second main vertical support member, such bar member being affixed in the first transverse openings of such first main support member and such second support member, such bar member being adapted to connect to a pair of hook-like ears on the rear portion of the attached work element, and with locking means on such coupling member to lock such coupling member to a working member.

Yet another summary of the subject invention is a universal coupling member adapted to be attached to the front end of a land-based vehicle for attachment of various work implements to such vehicle, such coupling drive comprising a longitudinally extending bottom base member having a longitudinal central axis, such longitudinally extending bottom base member having a right end and a left end, and having an upper surface, and a longitudinally extending upper base member having a right end and a left end, such upper base member having an upper surface and a vertically extending support member connecting such bottom base member to such upper base member, and wedge-shaped means integrally affixed to the upper surface of such upper base member adapted to receive mating wedge-shaped members, and connecting means affixed to both the left ends and right ends respectively of each of the bottom base member and upper base member, such connecting means being adapted to receive and connect a portion of such land-based vehicle, such connecting means having shaft openings therein and hydraulically actuated cylinder and shaft means disposed on each side of the vertically extending support member cylinder and shaft means being reciprocally movable in and out of such shaft openings in such connecting means.

I claim:

1. A universal coupling device attached to the front end of a motor vehicle for attachment of various work implements to said work vehicle, said coupling device comprising:

(a) a longitudinally extending base support member having a longitudinal central axis;

(b) first vertical main support member and second vertical main support member, each said vertical main support member having an upper portion and a lower portion, both said vertical main support members being vertically disposed parallel to one another in tandem fashion, both said main vertical support members being integrally affixed on their respective lower portions to said base member, said first vertical main support member and said second vertical main support member each having a transverse opening in the upper portion wherein said transverse opening in the upper portions of said first and second vertical main support members are coaxially aligned along a common axis, and wherein said first vertical main support member and said second vertical main support member each having a second transverse opening disposed in a portion of the vertical main support members at a portion of said vertical main support members above said base support member, said second transverse openings in such respective vertical main support members being coaxially aligned along a common axis;

(c) a first secondary vertical support member and a second secondary vertical support member with the first such secondary vertical support member being integrally affixed to and in a position immediately outboard of said first vertical main support member, and said second secondary vertical support member being integrally affixed to and in a position immediately outboard of said second vertical support member, said first and second secondary vertical support members each having three sets of openings therein, each set aligned along a common axis, with one such set being adapted to hold a removable shaft;

(d) a longitudinally extending circular shaft member affixed to the first main vertical support member and disposed between said first main vertical support member and said first secondary vertical support member, said circular shaft member being adapted to be inserted reciprocally in the first transverse openings of said first secondary vertical support member, said circular shaft member being adapted to connect to an ear on the rear portion of the attached work implement.

2. A universal coupling device attached to the front end of a motor vehicle for attachment of various work implements of said work vehicle, said coupling device comprising:

(a) a longitudinally extending base support member having a longitudinal central axis;

(b) first vertical main support member and second vertical main support member, each said vertical main support member having an upper portion and a lower portion, both said vertical support members being vertically disposed members being parallel to one another in tandem fashion, both said vertical main support members being integrally affixed on their respective lower portions to said base member, said first vertical main support member and said vertical second main support member each having a transverse opening in the upper portion wherein said transverse opening in the upper portions of said first and second vertical main support members are coaxially aligned along a common axis, and wherein said first vertical main support member and said second vertical main support member each having a second transverse opening disposed in a portion of the vertical main support members at a portion of said vertical main support members above the base support member, said second transverse openings in such respective main support members being coaxially aligned along a common axis;

(c) a first secondary vertical support member and a second vertical secondary support member with the first such secondary vertical support member being integrally affixed to and in a position immediately outboard of said first vertical support member, and said second secondary vertical support member being integrally affixed to and in a position immediately outboard of said second main vertical support member, said first and second secondary vertical support members each having three sets openings therein, each set aligned along a common axis, with one such set being adapted to hold a removable shaft;

(d) a longitudinally extending circular shaft member affixed to the first main vertical support member and disposed between said first main vertical support member and said first secondary vertical support member, said circular shaft member being adapted to be inserted reciprocally in the first transverse openings of said first secondary vertical support member, said circular shaft member being adapted to connect to an ear on the rear portion of the attached work implement;

(e) locking means on said coupling device to lock said coupling device to a working member.

3. A universal coupling member adapted to be attached to the front end of a land-based vehicle for attachment of various work implements to said vehicle, said coupling device comprising:

(a) a longitudinally extending bottom base member having a longitudinal central axis, such longitudinally extending bottom base member having a right end and a left end, and having an upper surface;

(b) a longitudinally extending upper base member having a right end and a left end, said upper base member having an upper surface;

(c) a vertically extending support member connecting said bottom base member to said upper base member;

(d) wedge-shaped means integrally affixed to the upper surface of said upper base member adapted to receive mating wedge-shaped members;

(e) connecting means affixed to both the left ends and right ends respectively of each of the bottom base member and upper base member, said connecting means being adapted to receive and connect a portion of said land-based vehicle, said connecting means having shaft openings therein;

(f) hydraulically actuated cylinder and reciprocating shaft means integrally disposed on the vertically extending support member, said shaft means being adapted to move reciprocally in and out of the shaft openings in the connecting means, said hydraulically actuated cylinder adapted to move the reciprocating shaft means in a direction parallel to the longitudinal central axis of the bottom base member;

(g) a medial support member comprising a vertically disposed plate that extends vertically upwardly at the medial, frontal portion of said coupling device with the medial support member attached to the adjacent frontal surfaces of each of said bottom base member and said upper base member.

4. A universal coupling device attached to the fornt end of a motor vehicle for attachment of various work implements to said work vehicle, said coupling device comprising:

(a) a longitudinally extending base member having a longitudinal central axis;

(b) first vertical main support member and second vertical main support member, each said main support member having an upper portion and a lower portion, both said support members being vertically disposed members being parallel to one another in tandem fashion, both said main support members being integrally affixed on their respective lower portions to said base member, said first main support member and said second main support member each having a transverse opening in the upper portion wherein said transverse opening in the upper portions of said first and second main support members are coaxially aligned along a common axis, and wherein said first vertical main support member and said second vertical main support member each having a second transverse opening disposed in a portion of each of said vertical main support members above the base support member, said second transverse openings in such respective vertical main support members being coaxially aligned along a common axis;

(c) a first secondary vertical support member and a second secondary vertical support member with the first such secondary vertical support member being integrally affixed to and in a position immediately outboard of said first vertical main support member, and said second secondary support member being integrally affixed to and in a position immediately outboard of said second vertical main support member, said first and second secondary vertical support members each having three sets of openings therein, each set aligned along a common axis, with one such set being adapted to hold a removable shaft;

(d) longitudinally extending circulr shaft means affixed to the first main vertical support member and disposed between said first main vertical support member and said first secondary vertical support member, said circular shaft means being adapted to be inserted reciprocally in the first transverse openings of said first secondary vertical support member, said circular shaft means being adapted to connect to an ear on the rear portion of the attached work implement;

(e) first locking means affixed to the posterior upper surface of the work implement;

(f) second locking means affixed on the upper portion of the coupling member adapted to receive in mating fashion the locking means on the posterior surface of said work implement to help position the work implement against the coupling device;

(g) a medial support member that extends vertically on the front portion of the coupling device such medial support member attached to on its lower portion the adjacent frontal surface of the lower base member.

5. A universal coupling device attached to the front end of a motor vehicle for attachment of various work implements to said work vehicle, said coupling device comprising:

(a) a longitudinally extending base member having a longitudinal central axis;

(b) first vertical main support member and second vertical main support member, each said main support member having an upper portion and a lower portion, both said support members being vertically disposed members being parallel to one another in tandem fashion, both said main support members being integrally affixed on their respective lower portions to said base member, said first main support member and said second main support member each having a transverse opening in the upper portion wherein said transverse opening in the upper portions of said first and second main support members are coaxially aligned along a common axis, and wherein said first vertical main support member and said second vertical main support member each having a second transverse opening disposed in a portion of the respective vertical main support members at a portion of each of said vertical main support members above the base support member, said second transverse openings in such respective vertical main support members being coaxially aligned along a common axis;

(c) a first secondary vertical support member and a second secondary vertical support member with the first such secondary vertical support member being integrally affixed to and in a position immediately outboard of said first vertical main support member, and said second secondary support member being integrally affixed to and in a position immediately outboard of said second vertical main support member, said first and second secondary vertical support members each having three sets of openings therein, each set aligned along a common axis, with one such set being adapted to hold a removable shaft;

(d) longitudinally extending circular shaft means affixed to the first main vertical support member and disposed between said first main vertical support member and said first secondary vertical support member, said circular shaft means being adapted to be inserted reciprocally in the first transverse openings of said first secondary vertical support member, said circular shaft means being adapted to connect to an ear on the rear portion of the attached work implement;

(e) first triangularly-shaped locking means affixed to the posterior upper surface of the work implement;

(f) second triangularly-shaped locking means affixed on the upper portion of the coupling member adapted to receive in mating fashion the first triangularly-shaped locking means on the posterior surface of said work implement to help position the work implement against the coupling device;

(g) a medial vertically disposed support member extending on the front portion of the coupling device, and attached to the frontal surface of the base member.

* * * * *